US007677952B2

(12) United States Patent
Wooley

(10) Patent No.: US 7,677,952 B2
(45) Date of Patent: Mar. 16, 2010

(54) SUPPORTIVE, WASHABLE ADHESIVE BRA WITH DETACHABLE SUPPORT STRUCTURES

(76) Inventor: Susan Wooley, 7112 S. 47th Pl., Franklin, WI (US) 53132

( * ) Notice: Subject to any disclaimer, the term of this patent is extended or adjusted under 35 U.S.C. 154(b) by 0 days.

(21) Appl. No.: 12/185,622

(22) Filed: Aug. 4, 2008

(65) Prior Publication Data

US 2009/0093190 A1 Apr. 9, 2009

Related U.S. Application Data

(60) Provisional application No. 60/977,205, filed on Oct. 3, 2007.

(51) Int. Cl.
*A41C 3/00* (2006.01)

(52) U.S. Cl. ..... 450/81; 450/86; 450/88

(58) Field of Classification Search ..... 450/81, 450/88, 86, 54–58
See application file for complete search history.

(56) References Cited

U.S. PATENT DOCUMENTS

| | | | | |
|---|---|---|---|---|
| 2,590,915 | A * | 4/1952 | Allison | 450/82 |
| 3,297,036 | A | 1/1967 | Williams | |
| 3,826,266 | A * | 7/1974 | Alpert | 450/11 |
| 4,992,074 | A | 2/1991 | Diaz | |
| 6,200,195 | B1 * | 3/2001 | Furuno et al. | 450/81 |
| 6,231,424 | B1 | 5/2001 | Valentin | |
| 6,257,951 | B1 | 7/2001 | DeMarco | |
| 6,257,952 | B1 | 7/2001 | Valentin | |
| 6,383,055 | B2 | 5/2002 | Valentin | |
| 6,397,391 | B2 | 6/2002 | DeMarco | |
| D478,406 | S | 8/2003 | Valentin | |
| 6,645,042 | B2 | 11/2003 | Davis | |
| 6,758,720 | B2 | 7/2004 | Chen | |
| 6,780,081 | B2 | 8/2004 | Chen | |
| 6,814,648 | B2 | 11/2004 | Chong | |
| 6,857,935 | B1 | 2/2005 | Dohan | |
| 6,916,224 | B2 | 7/2005 | Chen | |
| 7,052,359 | B2 | 5/2006 | Chen | |
| 7,229,335 | B2 | 6/2007 | Davis | |
| 7,335,086 | B1 * | 2/2008 | Karon | 450/81 |

* cited by examiner

*Primary Examiner*—Gloria Hale
(74) *Attorney, Agent, or Firm*—Absolute Technology Law Group, LLC

(57) ABSTRACT

A strapless brassiere having winged support structures to maximize surface area of the bra to which an extended-wear adhesive is applied over substantially all of the undersurface of the bra.

14 Claims, 3 Drawing Sheets

SUPPORTIVE, WASHABLE ADHESIVE BRA WITH DETACHABLE SUPPORT STRUCTURES

CROSS-REFERENCE TO RELATED APPLICATIONS

This application claims priority to U.S. Provisional Application No. 60/977,205 filed Oct. 3, 2007.

FIELD OF INVENTION

This invention relates generally to the field of brassieres, and in particular strapless, backless brassieres secured with an adhesive substance.

BACKGROUND

Figure 1:
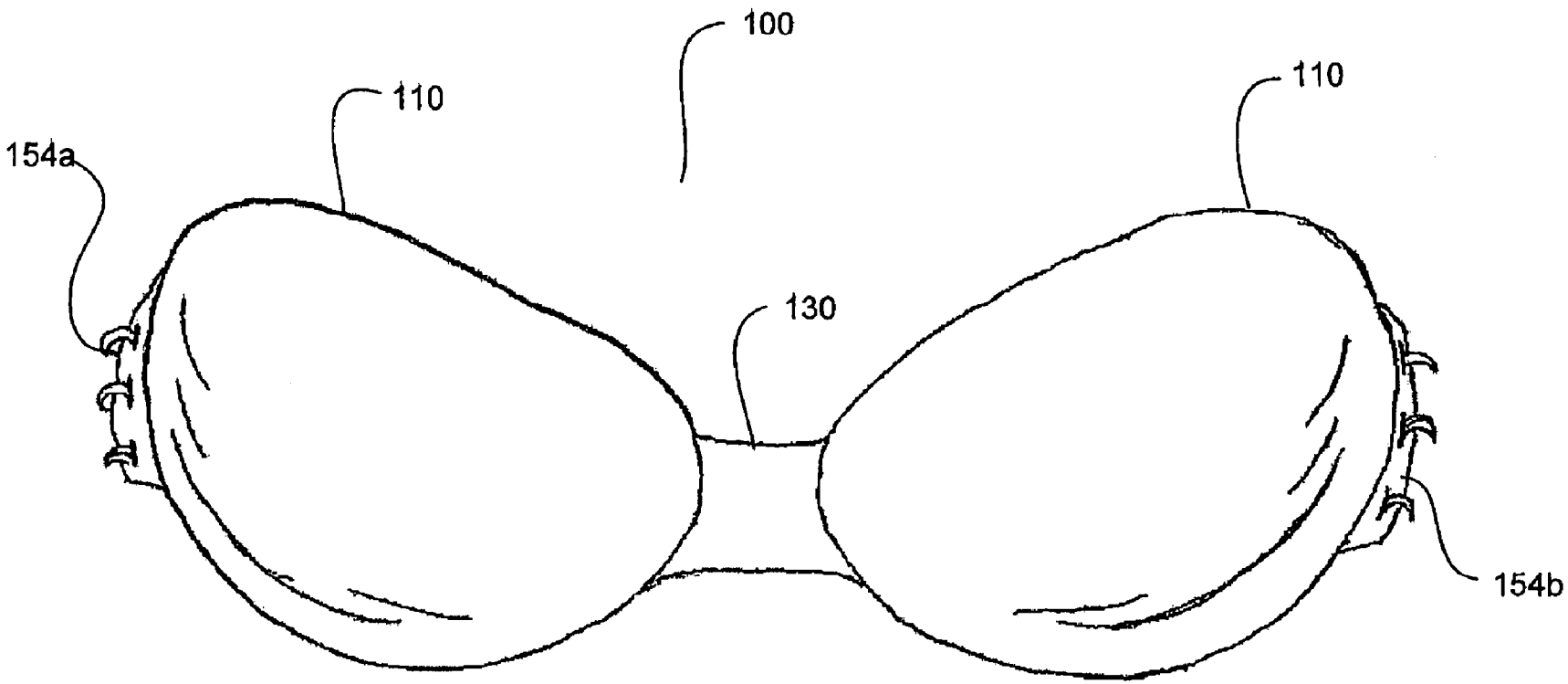
FIG. 1 shows a front perspective view of one embodiment of a strapless brassiere.

Brassieres ("bras") are generally undergarments which a wearer wants to conceal, and which are worn to contour and support the breasts. A backless and strapless bra is a device known in the art and worn under clothing when a bra with traditional shoulder straps would appear under the clothing and detract from the appearance of the clothing. Backless and strapless bras secured to the breast area by adhesive substances to support and cover the breasts are known in the art.

Generally, backless and strapless bras known in the prior art are garments comprised of two cups and connecting material as well as some extraneous material around the cups of the bra extending toward the underarm area. These garments, known in the prior art, provide contouring and a smooth appearance or silhouette to the breasts under clothing, and may also contain padding to further enhance the appearance and shape of the breasts. However, because straps are not present, there is no upward support or counterpressure to counteract gravity resulting in an unsupported appearance of the breasts. Accordingly, backless and strapless bras known in the art have traditionally provided limited support for breasts because of the absence of straps. Thus, women who desire supportive bras are often deterred from wearing backless, strapless bras, and are thus limited in their ability to wear backless and strapless styles of clothing. There is a significant market segment of women desiring the support of a traditional bra having straps, but who would like to wear backless and/or strapless clothing.

A further drawback of strapless adhesive bras, in addition to the loss of support, is the inability to launder the garment. Generally, adhesives which hold strapless bras in place lose their effectiveness upon exposure to moisture, humidity and turbidity while being worn or during the laundering process.

Still another drawback of the prior art is the use of adhesives which are insufficient to hold a garment in place, given the counterpressure of the breasts being supported, for substantial periods of time (e.g., more than a few hours). These adhesives may be applied in a thin coat or over only the cup portions of the bra, and thus an adhesive bra can be worn for only a limited time and/or are disposable bras.

Further, strapless bras are often constructed using minimal fabric to minimize the appearance of the bra under clothing, and thus have limited surface area on which adhesive can be applied.

It is desirable to have a strapless, backless bra which provides support and counterforce of a type and/or in a manner similar to traditional bras having back and/or shoulder straps, but which does not have visible support structures such as straps.

It is further desirable to have a backless, strapless bra which may be laundered, and to which a sufficient quantity of adhesive may be applied over a sufficient surface area to allow continuous wear and support over several hours and on multiple occasions.

SUMMARY OF INVENTION

The present invention is a backless, strapless bra which uses novel winged support structures to maximize surface area of the bra while maintaining its unobtrusive appearance under clothing. Adhesive is applied over a design having increased surface area created by winged support structures. An extended-wear adhesive surface is created by applying multiple coats of adhesive to the surface to strengthen the adhering capability of the bra. The adhesive is washable, and adapted for extended wear.

Glossary

As used herein, the term "winged support structure" means a strip of fabric, plastic or other material that extends from the outer edge of a cup of a bra and extends past the underarm area to maximize the surface to which adhesive can be applied and be adhered to skin outside or adjacent to the breast area (e.g., underarm, side, and back area) to provide counterforce and/or support to counteract the gravitational pull of the breasts. A winged support structure does not encircle the shoulder or back as does a traditional bras strap. A winged support structure may be made selectively attachable by any means know in the art such as hooks, snaps, clasps, Velcro and loops. A winged support structure may also be permanently attached by sewing, or may consist of fabric cut from the same piece as the cup portion of the bra. A winged support structure may be made of fabric, clear or tinted plastic, nylon, paper or any other substance capable of being formed in the shape of a winged support structure and which provides support as disclosed herein.

As used herein, the term "cup" means a portion of a bra partially enclosing a breast, and which may further serve the function of contouring or shaping the breasts. A cup may include additional components such as padding, underwire, or ornamentation such as lace. For example, a cup may include push-up padding, natural textured materials, gel inserts or underwire support. These devices may be fixedly attached to the garment or detached from the garment.

As used herein, the term "brassiere or bra" means any undergarment worn on the breasts including but not limited to fabric, paper, and reusable and disposable undergarments. For example, a bra may include push-up padding, natural textured materials, gel inserts, underwire support, sporting styles, and more. These devices may be fixedly attached to the garment or detached from the garment.

As used herein, the term "extended-wear adhesive" means an adhesive capable of supporting the weight of the wearer's breasts for several hours, and which is of sufficient quantity and applied over a sufficient surface area to do so. For example, an extended wear adhesive may include an 80-100% silicone adhesive applied by a process which applies multiple coats and extends the adhesive over substantially all of the surface area of the garment. An extended wear adhesive may be an adhesive with enhanced adherent qualities because it is created by applying more than one or multiple layers of adhesive.

DESCRIPTION OF EXEMPLARY EMBODIMENTS OF THE INVENTION

For the purpose of promoting an understanding of the present invention, references are made in the text hereof to embodiments of a supportive, washable adhesive bra with detachable support structures, only some of which are depicted in the figures. It should nevertheless be understood that no limitations on the scope of the invention are thereby intended. One of ordinary skill in the art will readily appreciate that modifications such as the size and shape of the bra, the inclusion of fewer and/or additional elements, ornamental features, and the inclusion of additional breast enhancers are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed system, structure, or manner.

It should be understood that the drawings are not necessarily to scale, emphasis instead being placed upon illustrating the principles of the invention. In addition, in the embodiments depicted herein, like reference numerals refer to identical or nearly identical structural elements in the various drawings.

Moreover, the term "substantially" or "approximately" as used herein may be applied to modify any quantitative representation that could permissibly vary without resulting in a change in the basic function to which it is related. For example, in the embodiment shown, the bra is disclosed herein as an underwire encircling the lower portion of the bra cup in order to provide shape and support to the wearer. Other embodiments may include other adhesive support structures, such as an adhesive member which extends to the neck or shoulders for a variety of support configurations. In addition, a variety of configurations of hooks clips, clasps, snaps, or material may be used to secure the cups together.

Referring now to the drawings, FIG. 1 shows a front perspective view of one embodiment of a brassiere 100. In the embodiment shown, the brassiere 100 is comprised of two cups 110*a* and 110*b*, optional center attachment member 130, and winged support structures 150*a* and 150*b* (not visible). In the embodiment shown center attachment member is additional fabric between cups 110*a* and 110*b* which provides additional surface area to which adhesive can be attached.

Winged support structures 150*a* and 150*b* are attached at sides 154*a* and 154*b*to cups 110*a* and 110*b* by snaps, hooks, claps, seams or any method of attachment known in the art. The winged support structures 150*a* and 150*b* may be attached so they extend toward the underarms, or may be angled, slanted, offset or otherwise configured in a horizontally offset fashion in a plane that is parallel to the surface of the wearer's skin to increase support and/or provide angled as well as parallel force. Winged support structures 150*a* and 150*b* may be of a length and configuration to be unobtrusive under a garment and may or may not extend along and/or past the underarm or back areas. In the embodiment shown winged support structures 150*a* and 150*b* are covered with an extended wear adhesive layer 152*a* and 152*b* (not visible) and are detachable and selectively removable to maximize surface area of the adhesive layer which adheres to the skin depending on the outer garment worn.

In the embodiment shown, cups 110*a* and 110*b* and winged support structures 150*a* and 150*b* are composed of a 80% polyamide and 20% spandex blended material. This material provides maximum support and contouring. However, in other embodiments these ranges may vary. For example, the cups 110*a* and 110*b* may be composed of as low as 40% polyamide and as high as 90% polyamide and as low as 10% spandex and as high as 60% spandex or may include other materials, natural or synthetic, offering similarly bonding qualities, flexibility, functionality and support. In other embodiments, cups 110*a* and 110*b* have one layer; other embodiments may have additional layer(s) including padding, shaping material, or a layer(s) into which an underwire or another material used for supporting or enhancing the appearance of the wearer may be sewn. Cups 110*a* and 110*b* may be a variety of shapes or sizes allowing for various amounts of support, coverage, and styles for the wearer. In the embodiment shown, the inside surface of cups 110*a* and 110*b* contain a volume of adhesive material covering the entire inside surface of cup 110*a* and 110*b* to secure the brassiere 100 to the wearer's breasts.

In the embodiment shown, the extended wear adhesive layer 152*a* and 152*b* (not visible) is 100% silicone and is comprised of four adhesive layers to provide extended wear. Other embodiments may have fewer or additional adhesive layers of the same or varying adhesive substances. The adhesive layers are applied to substantially all of the surface area of the brassiere 100 and structures attached to the brassiere 100 including the under surface (skin side) of the cups 110*a* and 110*b* and winged support structures 150*a* and 150*b*. In other embodiments, the adhesive may be comprised of or contain a material other than silicone, or may be applied in more or fewer layers. Additionally, in other embodiments, the number of layers and/or thickness of the adhesive layers may vary in order to achieve the desired extended wear adhesive.

In the embodiment shown, center attachment member 130 permanently or removably adjoins cups 110*a* and 110*b* and may be composed of a non-removable piece of material, or metal or plastic clips, clasps, snaps, hooks, buttons or any other fastening device known in the art. In the embodiment shown, winged support structures 150*a* and 150*b* are affixed to the outer side surface of cups 110*a* and 110*b*, via plastic or metal hooks, snaps, clips, clasps, buttons, tape, or any other fastening device known in the art. In other embodiments, center attachment member 130 may be omitted, and may or may not be covered with extended wear adhesive.

Figure 2:
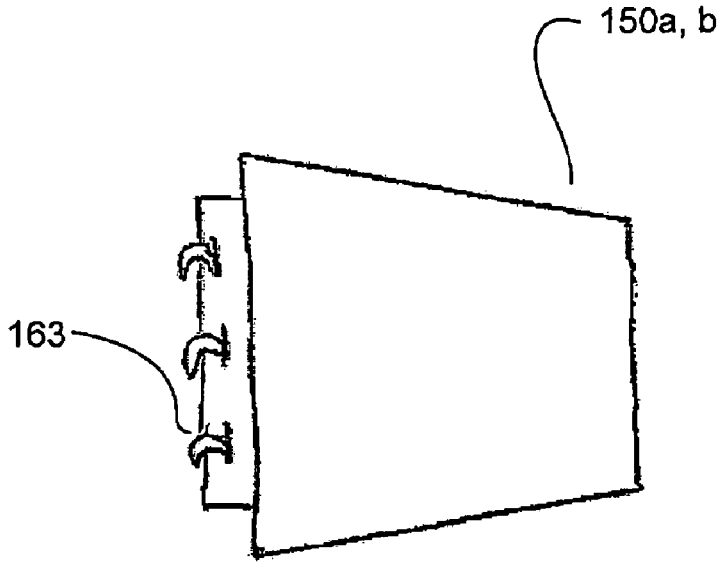
FIG. 2 shows a front perspective view of a winged support member.

FIG. 2 shows a front perspective view of an exemplary embodiment of a winged support structure 150*a* and 150*b*. In the embodiment shown, winged support structure 150*a* and 150*b* is constructed of the same material as the cups 110*a* and 110*b* (not shown). In the embodiment shown, cups 110*a* and 110*b* and winged support structures 150*a* and 150*b* are composed of an 80% polyamide and 20% spandex blended material; however, they can be made of any fabric, natural or synthetic, and may adhere to: the body at various angles and the proportions of polyamide and spandex may vary. Additionally, other embodiments may include or be constructed of other fabrics such as cotton, silk, wool, rayon, leather, suede and combinations thereof. The length, size and/or shape of winged support structures 150*a* and 150*b* may vary. In the embodiment shown, hooks 163 adhere winged support structures 150*a* and 150*b* to the cups 110*a* and 110*b*.

Figure 3:
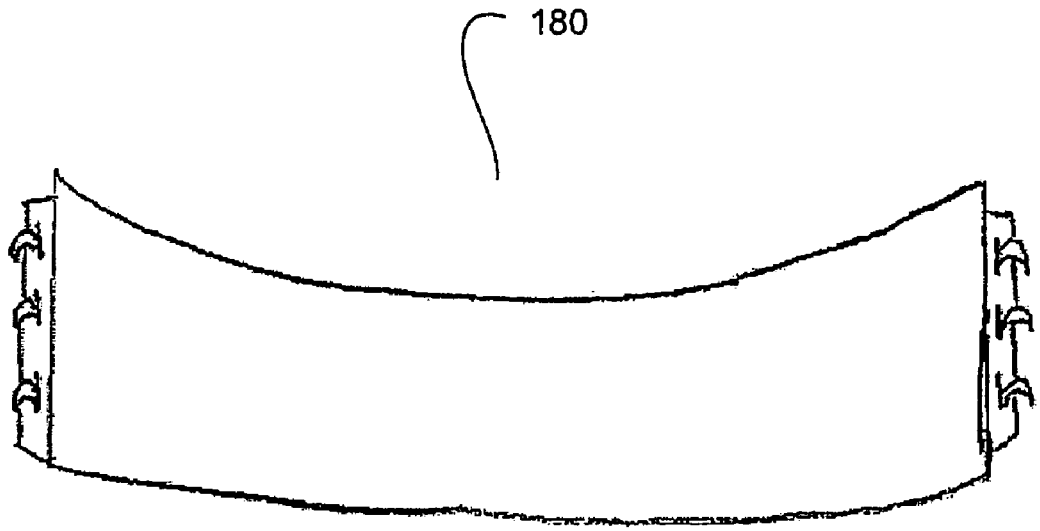
FIG. 3 shows a further embodiment of a winged support member.

FIG. 3 illustrates a front perspective view of an exemplary embodiment of a back strap 180 which may be attached to the cups 110*a* and 110*b* via snaps, hooks, clasps, seams or any method of attachment known in the art, adding additional support. In other embodiments, an optional neck or shoulder strap may be affixed to the cups 110*a* and 110*b* for additional support; the neck or shoulder strap may or may not have an adhesive surface.

Figure 4:
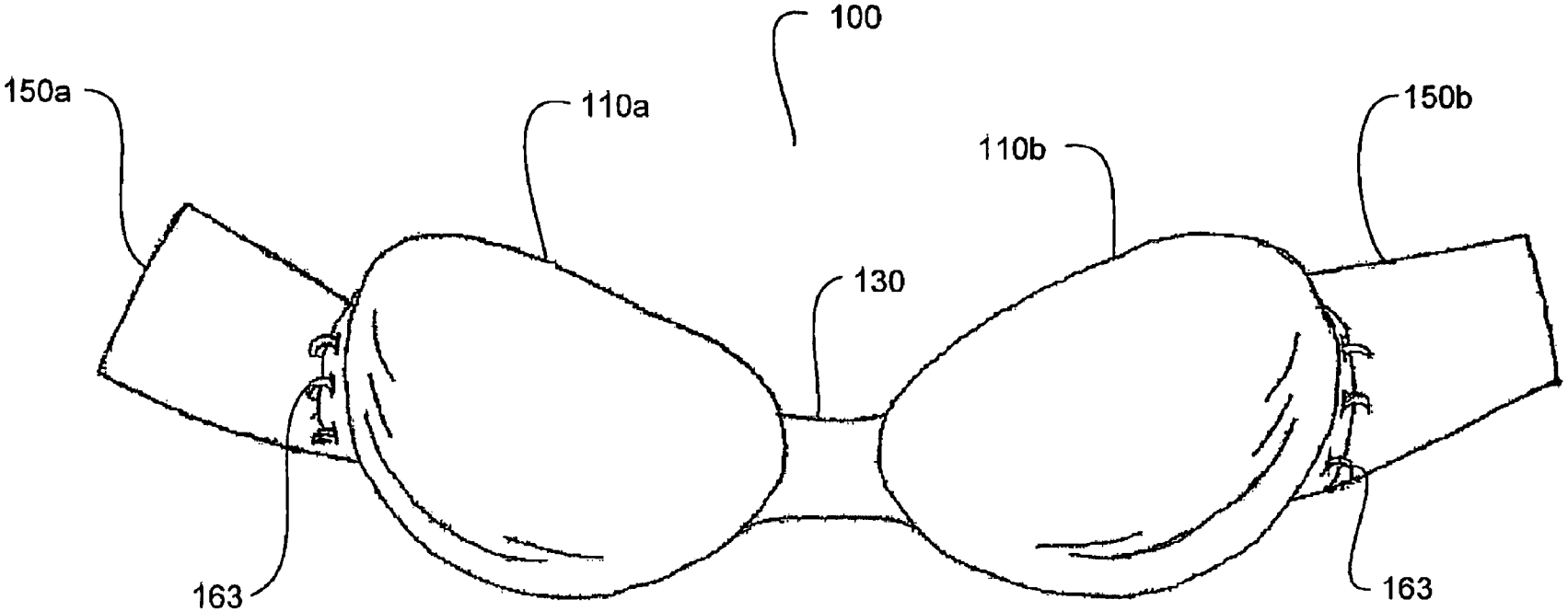
FIG. 4 shows a front perspective view of a strapless brassiere with selectively attachable winged support members.

FIG. 4 illustrates an embodiment of a brassiere 100 with attached winged support structures 150*a* and 150*b* which extend toward the wearer's underarms. In the embodiment shown, hooks 163 are used to affix the winged support structures 150*a* and 150*b* to the cups 110*a* and 110*b*, but in other embodiments, clips, clasps, snaps, hooks, buttons, tape, or any other fastening device known in the art. In the embodiment shown, one surface of winged support structures 150*a* and 150*b* is coated with extended wear adhesive 152*a* and 152*b* (not visible) which adheres to the wearer's skin. Winged support structures 150*a* and 150*b* may be fixedly attached to cups 110*a* and 110*b* or detachable.

What is claimed is:

1. A strapless brassiere comprising:

two cups having an outer surface and an undersurface said undersurface having multiple layers of adhesive, the entire said undersurface being covered with an extended-wear adhesive which temporarily adheres to the skin; and at least one slanted winged support structure which is selectively angled so that said slanted winged support structure is horizontally offset upwardly or downwardly in a plane parallel to the surface of the skin of the wearer to provide counterforce and/or support to counteract the gravitational pull of the breasts;

said slanted winged support structure having an outer surface and an undersurface which provides a maximized surface for application of multiple layers of adhesive, the entire said undersurface covered with an extended-wear adhesive which temporarily adheres to the skin, which allows said slanted winged support structure to be selectively attached to the wearer's skin surface at an angle determined by the user for the desired maximum support; and a means of attachment for attaching said slanted winged support structure to either of said two cups to allow for said horizontally offset angling.

2. The strapless brassiere of claim 1 wherein said means of attachment for said slanted winged support structure is selected from a group consisting of hook and loop fasteners, hooks, snaps and fasteners which enable said slanted winged support structure to be attached at either of each of said two cups at an angle determined by a user.

3. The strapless brassiere of claim 1 wherein said at least one slanted winged support structure is selectively attachable and detachable to either of said two cups and is positionable at an angle other than horizontal.

4. The strapless brassiere of claim 1 which includes two said slanted winged support structures which extend past the center point of the under-arm area of a wearer.

5. The strapless brassiere of claim 1 which includes two said slanted winged support structures which extend past the center point of the under-arm area of a wearer, and each of said winged support structure is selectively attachable at one side to the outer perimeter of each of said cups using an attachment component selected from a group consisting of clasps, hooks, snaps, hook and loop fasteners, and magnets.

6. The strapless brassiere of claim 1 which includes a single said slanted winged support structure which extends across the entire back of a wearer and is attached at each of it's side to the outer perimeter of said corresponding cup at each corresponding side using an attachment component selected from a group consisting of clasps, hooks, snaps, hook and loop fasteners and magnets.

7. The strapless brassiere of claim 1 which includes said slanted winged support structure which extends across the back includes a single band having two slanted ends.

8. The strapless brassiere of claim 1 wherein said extended wear adhesive is non-irritating to the nipples of the wearer.

9. The strapless brassiere of claim 1 which further includes a center support component having an extended-wear adhesive applied to the entire undersurface area.

10. The strapless brassiere of claim 1 which further includes fabric surrounding said cups having an extended-wear adhesive applied to the entire under surface.

11. The strapless brassiere of claim 1 which further includes padding to enhance the appearance of the breasts.

12. The strapless brassiere of claim 1 having said cups which include underwire to provide additional support to the breast.

13. The strapless brassiere of claim 1 wherein said adhesive is substantially all silicone.

14. The strapless brassiere of claim 1 wherein said cups and said slanted winged support structure is comprised of a 60% to 90% polyamide and 10% to 30% spandex blended material.

* * * * *